US006323144B1

(12) United States Patent
Dalbec

(10) Patent No.: US 6,323,144 B1
(45) Date of Patent: Nov. 27, 2001

(54) CONVERTIBLE FABRIC

(75) Inventor: Charles E. Dalbec, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/377,789

(22) Filed: Aug. 20, 1999

(51) Int. Cl.[7] ..... B32B 27/04; B32B 27/12; D03D 13/00

(52) U.S. Cl. ..... 442/120; 442/76; 442/155; 442/170; 442/173; 442/203; 442/205; 442/206; 442/218; 442/239; 442/250; 162/901

(58) Field of Search ..... 442/76, 120, 155, 442/170, 173, 239, 250, 203, 205, 206, 218; 162/901

(56) References Cited

U.S. PATENT DOCUMENTS 4,537,816 * 8/1985 Booth et al. ..... 428/234
5,102,725 * 4/1992 Knox et al. ..... 428/245
5,147,713 9/1992 Dalbec et al. .
5,175,034 * 12/1992 Andre De La Porte et al. ... 428/36.1
5,324,577 6/1994 Dalbec et al. .

* cited by examiner

*Primary Examiner*—Elizabeth M. Cole
*Assistant Examiner*—Arti R. Singh
(74) *Attorney, Agent, or Firm*—Terry T. Moyer; Jeffery E. Bacon

(57) ABSTRACT

A convertible fabric having improved acoustical and heat transfer properties comprising an elastomeric polymer coating on a double woven fabric. The double woven having the standard sateen weave and the backing fabric of a plain weave interconnected to the sateen weave fabric with one surface of the plain weave coated with an elastomeric polymer to provide air spaces between the fabrics of the double woven fabric.

5 Claims, 3 Drawing Sheets

CONVERTIBLE FABRIC

This invention relates to a double woven fabric with sound deadening and low heat transfer qualities for use, in particular, in the manufacture of tops for convertibles.

Prior to this invention it was difficult to reduce the noise transmission and heat transfer into and out of a convertible when the top was up unless the top was multilayered requiring a series of manufacturing operations. This not only required additional fabrics but was costly to produce because of the numerous steps involved in putting the numerous layers together to form a convertible top.

Therefore it is an object of the invention to provide a woven fabric with improved sound deadening and heat transfer properties that is simple to manufacture and is as strong as competitive fabrics.

A further object of the invention is to provide a convertible top fabric having improved sound deadening and heat transfer properties.

Other objects and advantages of the invention will become readily apparent as the specifications proceed to describe the invention with reference to the accompanying drawings in which.

In the preferred form of the invention the basic double woven fabric is used to make a convertible top fabric but such use is only preferred because it can readily be seen that the disclosed double woven fabric could be used for other purposes such as a sound barrier for wall panels, a cubicle curtain, a substrate for simulated leather, etc.

Figure 1:
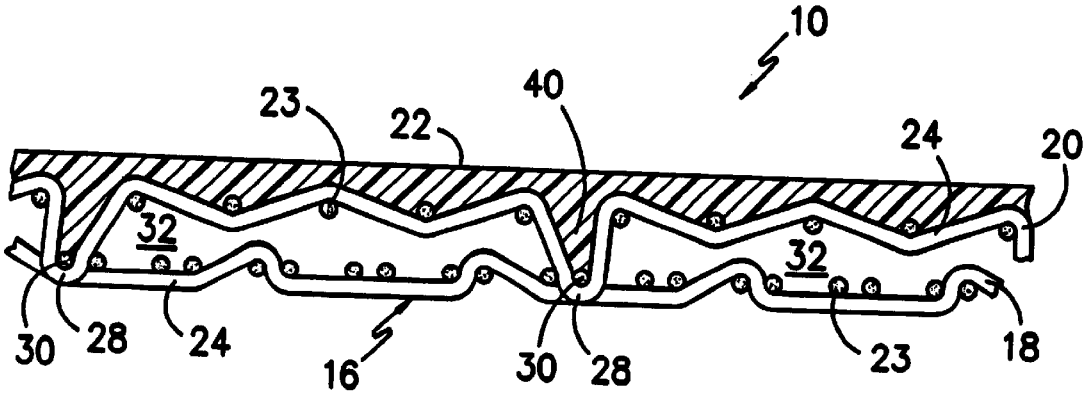
FIG. 1 is a cross-section view across the fill direction of the new and improved fabric used in the automobile convertible top shown in FIG. 2.
Figure 2:
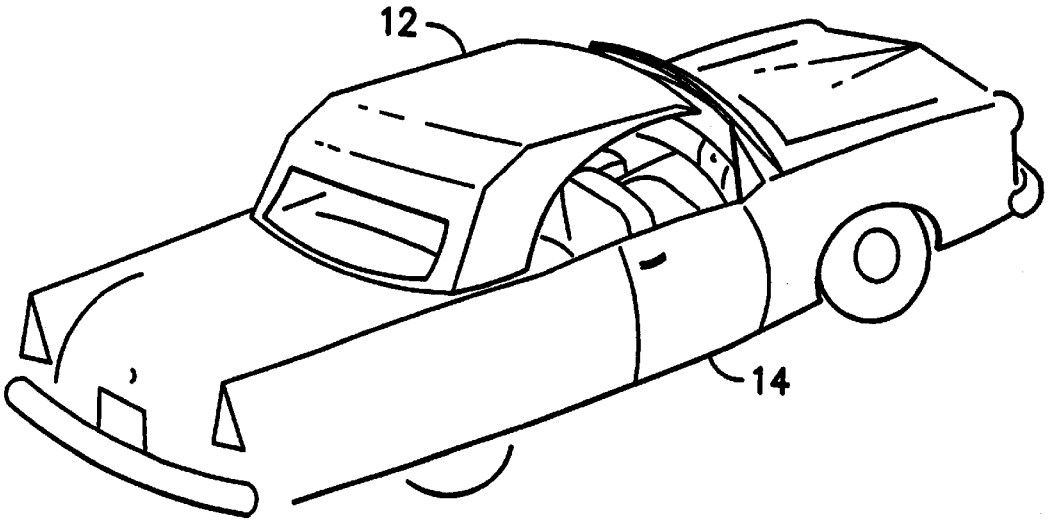

Looking now to FIGS. 1 and 2 the reference number 10 represents a double woven coated fabric 10 for use in a convertible top 12 for an automobile or truck 14. The double woven coated fabric 10 consists of a double woven fabric 16 having a lower standard sateen weave fabric 18, an upper plain weave fabric 20 and an elastomeric polymer coating 22 of vinyl, such as PVC, or rubber or synthetic rubber or other suitable elastomeric polymers depending on the desired use of the fabric 16. For use as a convertible fabric the coating 22 is preferably a PVC vinyl coating.

As discussed above the double woven fabric 16 consists basically of a standard sateen weave fabric 18 and an upper weave fabric woven preferably of 65/35 blend of polyester-cotton with all the warp yarns 24 being 15's cotton count and the fill yarns 23 being 10's cotton count. The finished fabric is 60" wide with 108 ends per inch and 62 picks per inch. Other suitable yarns such as a 50/50 blend of polyester-cotton can be used if desired.

Figure 3:
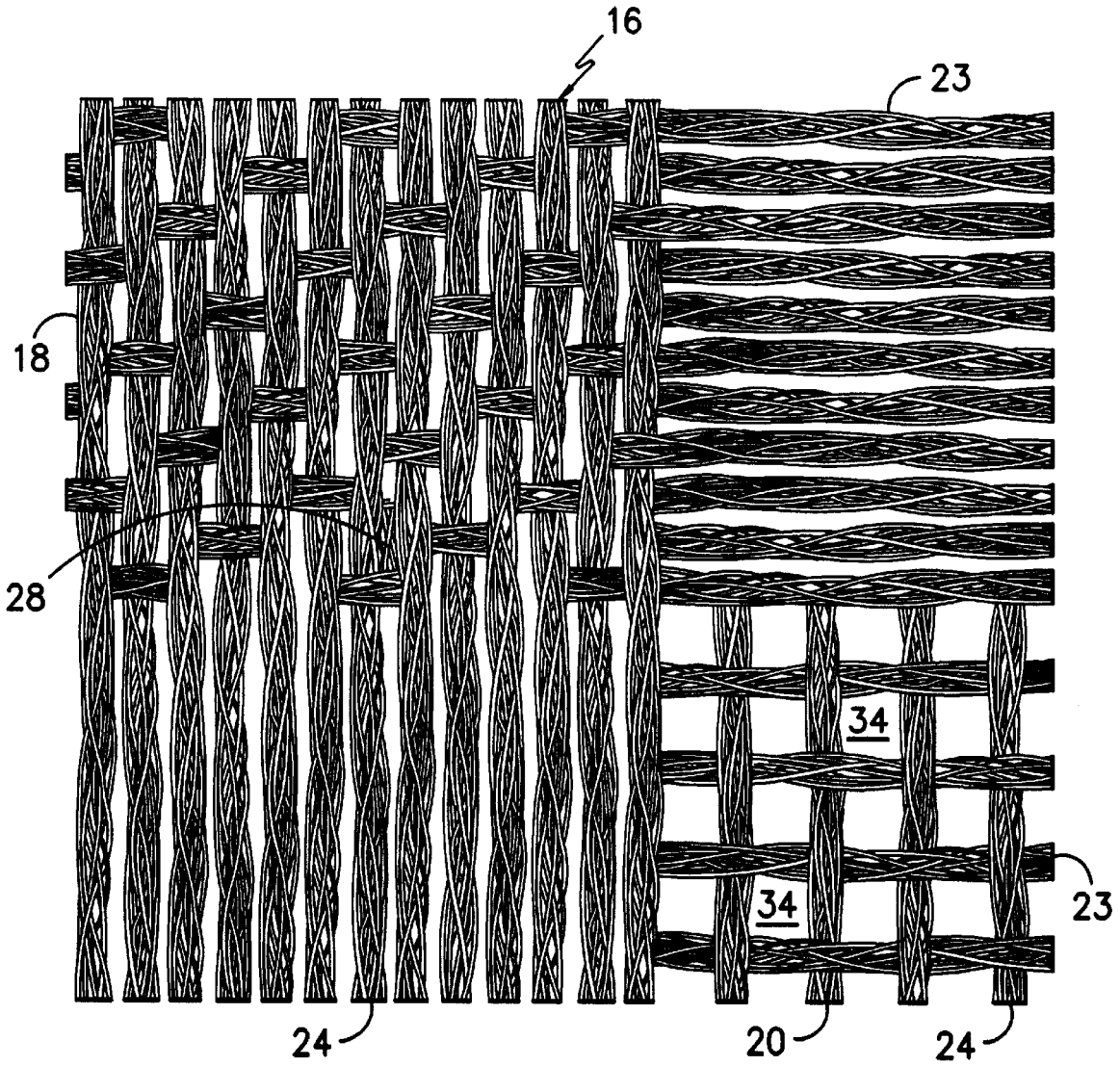
FIG. 3 is a top schematic view of the substrate fabric shown in FIG. 1
Figure 4:
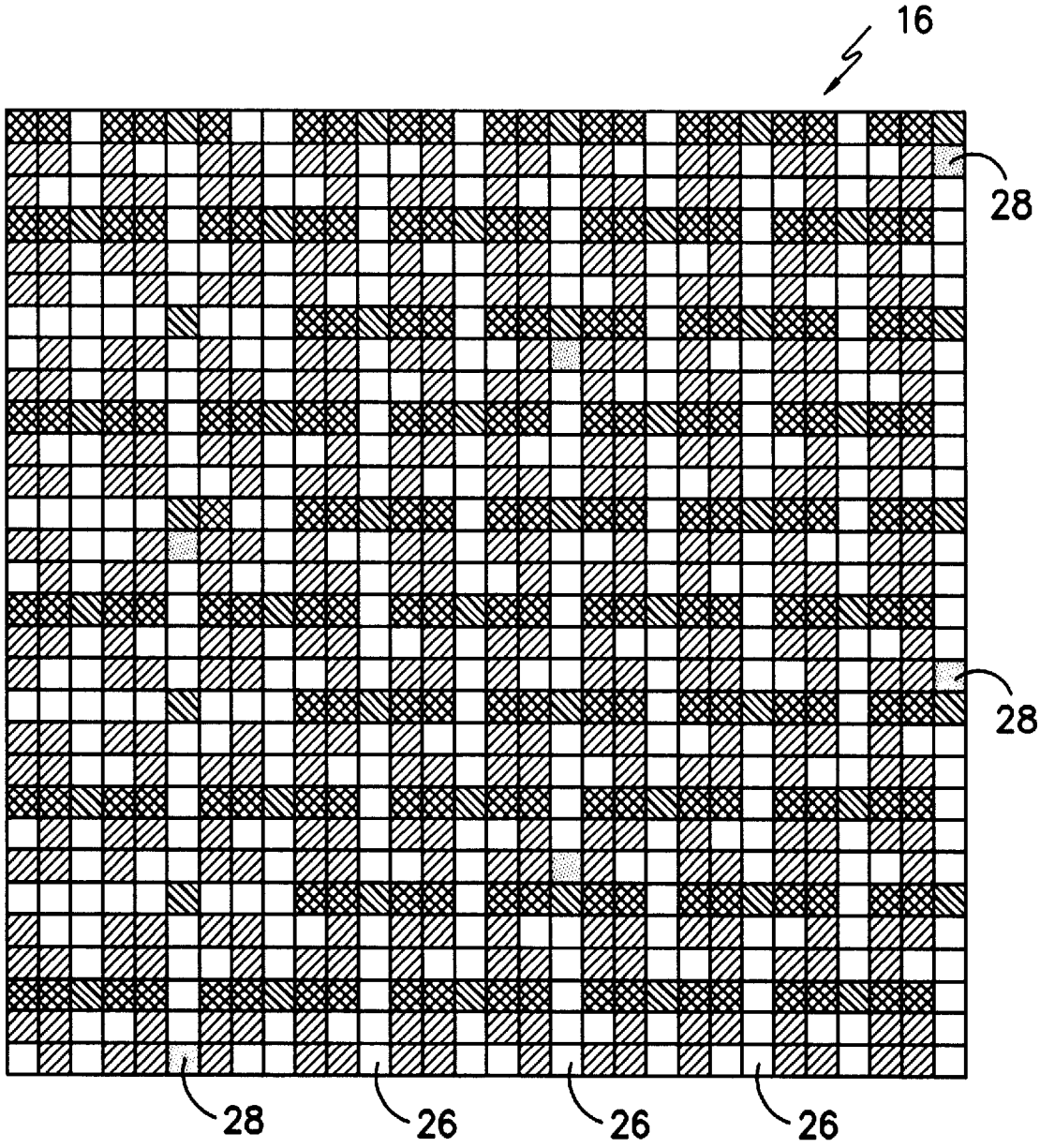
FIG. 4 is an exploded weave diagram of the double woven fabric shown in FIGS. 1 and 3.

Looking at FIG. 4 which is a schematic weave diagram the yarns have been spaced to show the upper and lower fabrics 20, 18 respectively. The spaces 26 between adjacent warp yarns 24 of the sateen fabric are provided to show the plain weave fabric 20 from which certain warp yarns 28 are raised from the surface thereof to encompass certain fill yarns 30 of the sateen weave fabric 18 to secure the two layers of the fabric together and at the same time provide a space 32 therebetween when coated which acts as an air space to provide sound deadening and improved heat insulation properties to the fabric while allowing the fabric to be readily produced on a loom. FIG. 3 clearly indicates the openings 34 in the plain weave fabric 20 which when coated cooperates with the sateen weave fabric 18 to provide the desired improvement and help trap the air between the two fabrics.

The raising of the warp yarn 28 in the plain weave fabric 20 to encompass the fill yarn 30 of the sateen weave fabric 18 creates a connecting space 40 between the plain weave fabric 20 and the sateen weave fabric 18. As illustrated, the connecting space 40 is occupied by the coating 22.

As mentioned before the preferred use of the coated double woven fabric is for the manufacture of convertible tops but other uses are contemplated depending on the coating on the fabric. These uses include but are not limited to accoustical curtains or panels, leather like fabrics, wall panels or any other use where esthetics combined with strength and sound deadening quality is necessary.

Although the preferred embodimenat of the invention has been described it is contemplated that meny changes may be made within the scope of the invention and it is desired that the invention be limited only by the claims.

I claim:

1. A coated fabric comprising: a double woven substrate having a sateen weave fabric interconnected to a plain weave fabric such that a separation space exists between the sateen weave fabric and the plain weave fabric, and a elastomeric polymer coating on the surface of the plain weave fabric on the side opposite to the sateen weave fabric.

2. The fabric of claim 1 wherein said coating is PVC.

3. The fabric of claim 2 wherein said yarns in said fabric are 65/35 polyester-cotton.

4. The fabric of claim 1 wherein said coating is rubber or a rubber substitute.

5. The fabric of claim 4 wherein said yarns in said fabric are 65/35 polyester-cotton.

* * * * *